US006525301B1

(12) United States Patent
Graves et al.

(10) Patent No.: US 6,525,301 B1
(45) Date of Patent: Feb. 25, 2003

(54) COMBINATION OVEN WITH MANUAL ENTRY OF CONTROL ALGORITHMS

(75) Inventors: Todd Vincent Graves, Louisville, KY (US); Dennis Patrick Kill, Louisville, KY (US); Jesse Spalding Head, Louisville, KY (US); Charles Ray Smith, Shelbyville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/480,962

(22) Filed: Jan. 11, 2000

Related U.S. Application Data

(60) Provisional application No. 60/115,744, filed on Jan. 13, 1999, and provisional application No. 60/150,395, filed on Aug. 23, 1999.

(51) Int. Cl.[7] ..... H05B 6/68

(52) U.S. Cl. ..... 219/702; 219/685; 219/720; 219/719; 219/482; 219/506; 99/451; 99/325

(58) Field of Search ..... 219/702, 719, 219/720, 685, 506, 482, 492; 99/DIG. 14, 451, 325, 327, 332

(56) References Cited

U.S. PATENT DOCUMENTS

| | | | | | |
|---|---|---|---|---|---|
| 3,569,656 | A | * | 3/1971 | White et al. | 219/685 |
| 4,332,992 | A | | 6/1982 | Larsen et al. | |
| 4,480,164 | A | | 10/1984 | Dills | |
| 4,547,642 | A | | 10/1985 | Smith | |
| 4,568,810 | A | * | 2/1986 | Carmean | 219/702 |
| 4,661,670 | A | * | 4/1987 | Eke | 219/685 |
| 4,771,154 | A | | 9/1988 | Bell et al. | |
| 5,517,005 | A | * | 5/1996 | Westerberg et al. | 219/685 |
| 5,695,669 | A | | 12/1997 | Westerberg | |
| 5,877,477 | A | * | 3/1999 | Petty et al. | 219/506 |
| 6,064,048 | A | * | 5/2000 | Lim | 219/702 |

* cited by examiner

*Primary Examiner*—Philip H. Leung
(74) *Attorney, Agent, or Firm*—Armstrong Teasdale LLP

(57) ABSTRACT

A speed cooking oven includes a combination of radiant cooking units and a microwave cooking unit manually controllable using a rotary dial input selector coupled to a control panel for user selection of desired oven features. An alphanumeric display displays prompts and information to guide users through a feature selection process. A microprocessor executes a cooking algorithm based upon user defined constants entered via the rotary dial according to prompts on the alphanumeric display.

20 Claims, 12 Drawing Sheets

COMBINATION OVEN WITH MANUAL ENTRY OF CONTROL ALGORITHMS

CROSS REFERENCE TO RELATED APPLICATIONS

This application claims the benefit of U.S. provisional application No. 60/115,744, filed Jan. 13, 1999 and U.S. provisional application No. 60/150,395, filed Aug. 23, 1999.

BACKGROUND OF THE INVENTION

This invention relates generally to ovens and, more particularly, to a control system for a combination oven using both radiant and microwave energy.

Known ovens are either, for example, microwave or radiant cooking type ovens. For example, a microwave oven includes a magnetron for generating RF energy used to cook food in the oven cooking cavity. Although microwave ovens cook food more quickly than radiant ovens, microwave ovens do not brown the food. Microwave ovens therefore typically are not used to cook as wide a variety of foods as radiant ovens.

Radiant cooking ovens include an energy source such as lamps which generate light energy used to cook the food. Radiant ovens brown the food and generally can be used to cook a wide variety of foods. Radiant ovens, however, cook foods slower than microwave ovens.

Microwave and radiant cooking ovens typically include an array of keypads mounted to a control panel for enabling an operator to enter and select the feature options, and a numerical key pad numbered 0–9. The complexity of the control panel and the number of keypads mounted to the control panel increases as the appliance functionality and features increase. Such control panels are often complex for users to understand, offer little flexibility to the users, and do not provide users with an opportunity to adjust or review in-progress cooking without terminating the cooking. The complexity and inflexibility of such control systems increases a likelihood that the food will be cooked correctly.

Accordingly, it would be desirable to provide a user friendly, flexible, and easily controlled oven which provides the speed advantages of a microwave oven with the appealing browning advantage of a radiant ovens to cook a wide variety of foods.

BRIEF SUMMARY OF THE INVENTION

In an exemplary embodiment of the invention a speed cooking oven includes a microwave cooking unit for delivering microwave energy and at least one radiant cooking unit for delivering radiant energy into a cooking cavity. A control panel is operatively connected to the microwave cooking unit and radiant cooking unit for user manipulation to select desired oven features including pre-programmed cooking algorithms and manually entered cooking algorithms. A microprocessor is coupled to the control panel for executing a manually entered control algorithm based upon at least one of a user selected total COOK TIME and user selected POWER LEVEL for the microwave cooking unit and the radiant cooking unit.

The control panel includes a plurality of input keys and a rotary dial input selector for easy selection of desired features by rotating the dial and depressing the dial to enter a selection. An alphanumeric display is provided to prompt a user for control information and guide the user through the oven feature selection process. The oven is operable in a microwave only cooking mode, a lightwave only cooking mode and a speed cooking mode utilizing both radiant cooking units and microwave cooking units. Thus, a variety of foods may be quickly cooked and browned in the oven, and a flexible and straightforward cooking mode and control selection process is provided with the user friendly control panel.

DETAILED DESCRIPTION OF THE INVENTION

The present invention is directed, in one aspect, to operation of an oven that includes at least two types of cooking elements, such as radiant and microwave cooking elements. Although one specific embodiment of radiant/microwave cooking oven is described below, it should be understood that the present invention can be utilized in combination with many other such ovens and is not limited to practice with the oven described herein.

Figure 1:
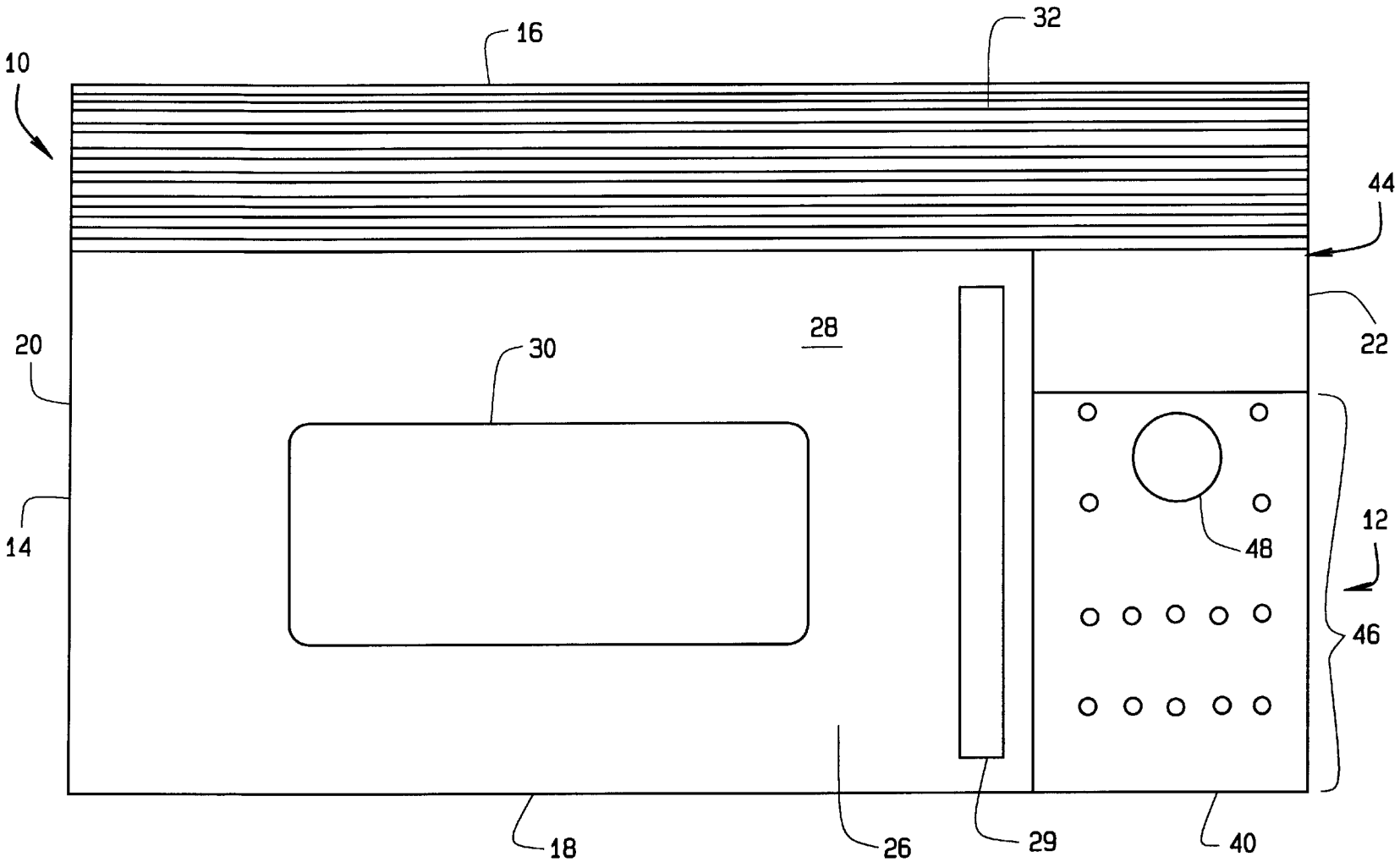
FIG. 1 is a front view of a combination oven including a control system.

FIG. 1 is a front view of an oven 10 including a control system 12 Oven 10 includes a body 14 which is constructed of a top 16, a bottom 18 which is connected to top 16 with a first side 20, a second side 22, and a rear side (not shown). Body 14 houses a cooking cavity (not shown) for receiving food (not shown) during cooking. A door 26 is hingedly attached to a front face 28 of body 14 and is pivotable to selectively open and close with a handle 29 to access the cooking cavity. Door 26 includes a window 30 fabricated from dark tinted glass having a thickness of about ⅛ inches which can withstand high temperatures, as is known in the art. Window 30 permits a user to visually inspect the cooking cavity during cooking without exposing the user to intense light generated while oven 10 is operated. Oven 10 also includes an extruded vent grill 32.

Control system 12 includes a control panel 40 for selecting control information (not shown in FIG. 1) and a control interface 44 for providing visual information about the cooking to a user. Control panel 40 includes a touch control area 46, described in more detail below, which provides the user with many feature options available during cooking. Control panel 40 also includes a rotary dial 48 configured to permit a user to select control information for cooking. Control panel 40 is operatively responsive to any selection of control information the user inputs using touch control area 46 and rotary dial 48.

Figure 2:
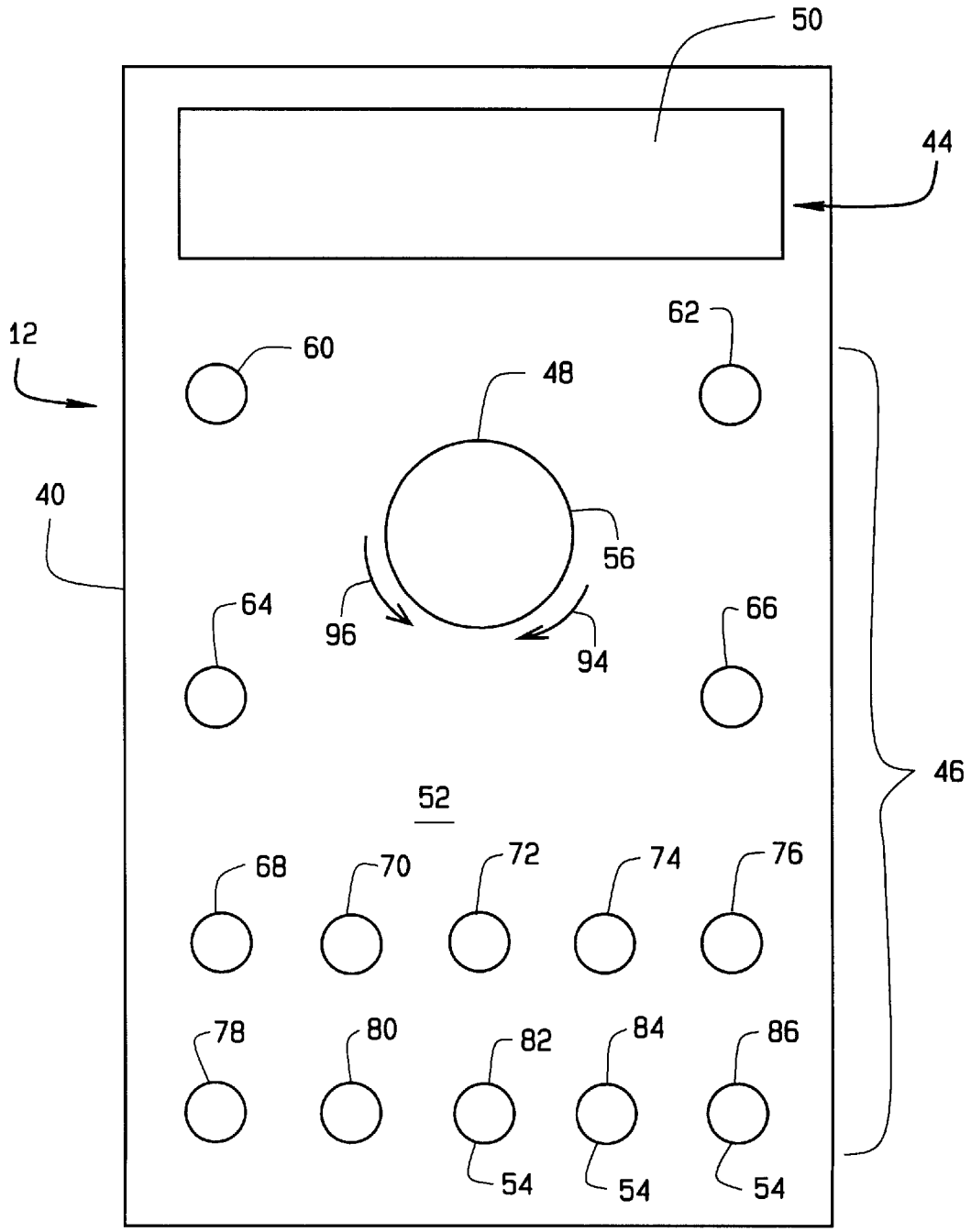
FIG. 2 is a front view of the control system shown in FIG. 1.

FIG. 2 is a front view of control system 12 including control panel 40 and control interface 44. Control interface 44 is mounted to control panel 40 and includes alphanumeric display 50. Alphanumeric display 50 displays the current time of day when oven 10 is not in operation. Additionally, during entry of control inputs by the user, alphanumeric display 50 provides visual prompts that guide the user through a selection process to select available options. In one embodiment, alphanumeric display 50 is a vacuum fluorescent display or LED type of display which displays multiple lines.

Control panel 40 includes touch control area 46 and rotary dial 48. A user may select control inputs using touch control area 46, rotary dial 48, or a combination of rotary dial 48 and touch control area 46. Touch control area 46 includes a face surface 52 which includes a plurality of keys 54 (described in more detail below) which extend from face surface 52 and are configured to permit a user to enter control inputs and activate feature options. Rotary dial 48 is rotationally attached to oven 10 and extends through an opening 56 in surface face 52. Each key 54 is connected to a control (not shown) which includes a microprocessor (not shown) or other electronic elements for executing user selected feature options.

Keys 54 provide a user with oven feature options and various cooking functions and are electrically operable when depressed by a user applying a minimal amount of pressure. More specifically, keys 54 include a COOK touch control pad 60, a START/PAUSE touch control pad 62, a MANUAL COOK touch control pad 64, a CLEAR/OFF touch control pad 66, a POWER LEVEL touch control pad 68, a DELAY START touch control pad 70, a TIMER touch control pad 72, a MICROWAVE touch control pad 74, a MICRO EXPRESS touch control pad 76, a VENT FAN touch control pad 78, a REMINDER touch control pad 80, an OPTIONS touch control pad 82, a HELP touch control pad 84, and a SURFACE LIGHT touch control pad 86.

Rotary dial 48 interacts with several of keys 54 and is connected to a control (not shown) which includes a microprocessor (not shown) or other electronic elements for executing user selected oven features. Rotary dial 48 is also connected to a select switch (not shown) which is operatively engaged when the user applies a moderate pressure to depress rotary dial 48 into opening 56.

Rotary dial 48 is configured to be rotated in a clockwise direction 94 or in a counter-clockwise direction 96. Rotation in clockwise direction 94 increments a numerical selection value (not shown) and scrolls non-numerical selections in ascending alphabetical order. Rotation in counter-clockwise direction 96 decrements the numerical selection value and scrolls non-numerical selections in reverse-alphabetical order. Rotary dial 48 is configured to provide tactile feedback to a user simultaneously as rotary dial 48 is rotated. The tactile feedback allows the user to determine an amount of rotation (not shown). In one embodiment, the tactile feedback has a resolution of approximately 15–25 counts per revolution. As such, when rotary dial 48 is rotated, the user will feel approximately 15–25 "stopping points" and thus, will sense an amount of rotation of rotary dial 48.

Oven features may be selected using touch control area 46, rotary dial 48, or a combination of rotary dial 48 and touch control area 46. In operation, plurality of keys 54 are configured to function in cooperation with rotary dial 48. Initially, a mode of oven 10 is selected from a lightwave only mode, a microwave only mode, and a speed cooking mode. Depressing touch control pad 60 results in the processor causing control interface 44 to visually prompt the user with alphanumeric display 50 for selections for the lightwave mode of oven 10. Depressing microwave touch control pad 74 results in the processor causing control interface 44 to visually prompt the user with alphanumeric display 50 for selections for the microwave mode of oven 10. Additionally, depressing microwave touch control pad 74 energizes a cooking lamp (not shown) to briefly illuminate the food being cooked.

Depressing COOK touch control pad 60 and rotating rotary dial 48 results in alphanumeric display 50 displaying pre-programmed control information including a listing of food types commonly cooked with a lightwave mode of oven 10.

Depressing MANUAL COOK touch control pad 64 and rotating rotary dial 48 permits the user to manually input control information before the cooking of the food is started, including the length of time for cooking and the power levels to be applied by oven 10. Additionally, depressing MANUAL COOK touch control pad 64 and then rotating rotary dial 48 permits the user to select combinations of non-preprogrammed cooking information.

Keys 54 also provide additional options and features to the user. Depressing POWER LEVEL touch control pad 68 enables the user to alter any pre-programmed suggested power levels. Depressing DELAY START touch control pad 70 permits the user to select a time of day for cooking to begin. Depressing TIMER touch control pad 72 permits the user to program the processor to control a timer. After an amount of time programmed into the timer has elapsed, the audible alarm sounds to indicate that the amount of time has elapsed.

Rubber tactile switch covers are located over each key pad of control panel 40, and dial 48 is provided for making multiple selections. Selections are made using dial 48 by rotating dial 48 clockwise or counter-clockwise and when the desired selection is displayed, pressing dial 48. The various selections available, in an exemplary embodiment, from dial 48 are set forth in Appendix A. Instructions and selections are displayed on alphanumeric display 50.

The following functions can be selected by user manipulation of control panel 40.

CLEAR/OFF Selecting this pad stops all cooking and erases the current program.

DELAYED Selecting this pad results in a delay in the start START of cooking.

HELP Selecting this pad enables an operator to find out more about the oven and its features.

MICROWAVE Selecting this pad enables defrosting, heating beverages, reheating leftovers, popcorn, vegetables, and all types of microwave cooking.

MICROWAVE Selecting this pad enables quick and easy

EXPRESS warming of a sandwich, or reheat of coffee.

OPTIONS Selecting this pad enables access to the auto

ON/OFF night light, beeper volume control, clock, clock display, and display scroll speed features.

OVEN LIGHT Selecting this pad during microwave cooking illuminates the cavity.

POWER LEVEL Selecting this pad enables adjusting the power levels for speed cooking and microwave cooking.

REMINDER Selecting this pad enables an operator to select a time at which an alarm is to sound.

REPEAT LAST Selecting this pad facilitates cooking repetitive items such as cookies and appetizers.

SPEED COOK Selecting this pad enables an operator to

MANUAL manually enter speed cooking time and power levels.

START/PAUSE Selecting this pad enables an operator to start or pause cooking.

SURFACE LIGHT Selecting this pad turns ON/OFF the surface light for the cooktop.

TIMER ON/OFF Selecting this pad controls a general purpose timer (e.g., minutes and seconds).

VENT FAN Selecting this pad enables an operator to clear the cooktop area of smoke or steam.

Figure 3:
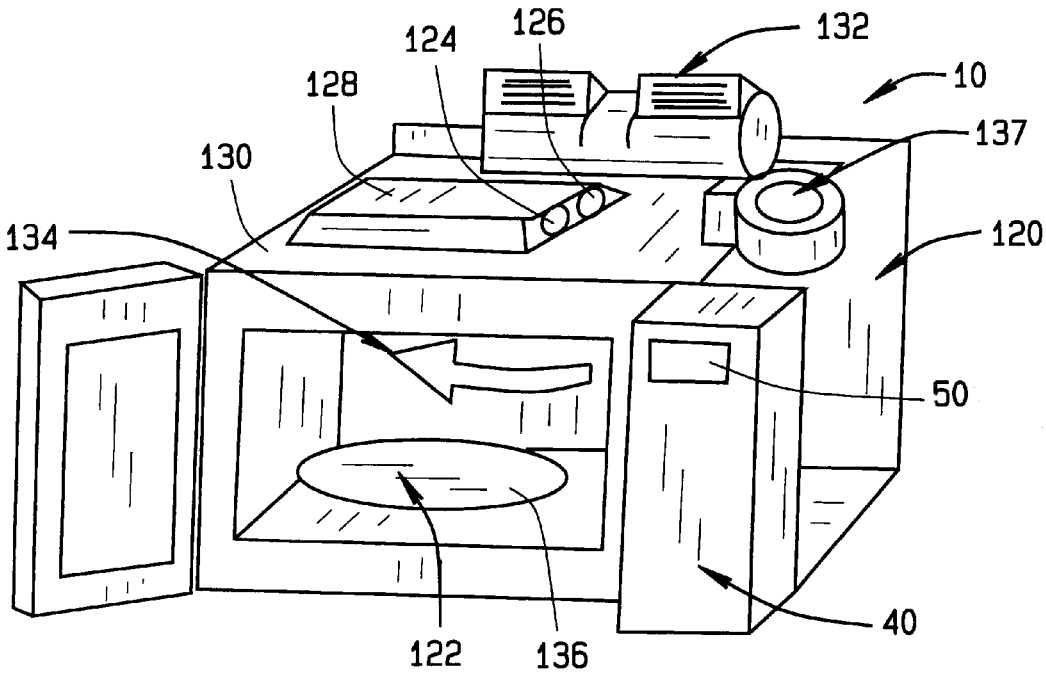
FIG. 3 is a perspective schematic view of a portion of the oven shown in FIG. 1.

FIG. 3 is a perspective schematic view of a portion of oven 10. Oven 10 includes a shell 120, and a cooking cavity 122 is located within shell 120. Cooking cavity 122 is constructed using high reflectivity (e.g., 72% reflectivity) stainless steel. Halogen lamps 124 and 126, and a reflective plate 128 are mounted to an upper panel 130 of shell 120. As described below in more detail, a halogen lamp also is located at a lower section of shell 120. An exhaust system 132 also is mounted to shell 120. Air flows through cavity 122 in a direction indicated by arrow 134. A cooling system 137 is mounted to shell 120 for cooling oven components. Exemplary dimensions of oven 10 are set forth below.

| Shell | |
|---|---|
| Exterior Height (front) | 15 11/16" |
| Exterior Height (rear) | 16 1/2" |
| Exterior Width | 29 4/5" |
| Exterior Depth | 14 4/5" |
| Cooking Cavity | |
| Cavity Height | 8 2/5" |
| Cavity Width | 19 2/7" |
| Cavity Depth | 13 3/5" |

Figure 4:
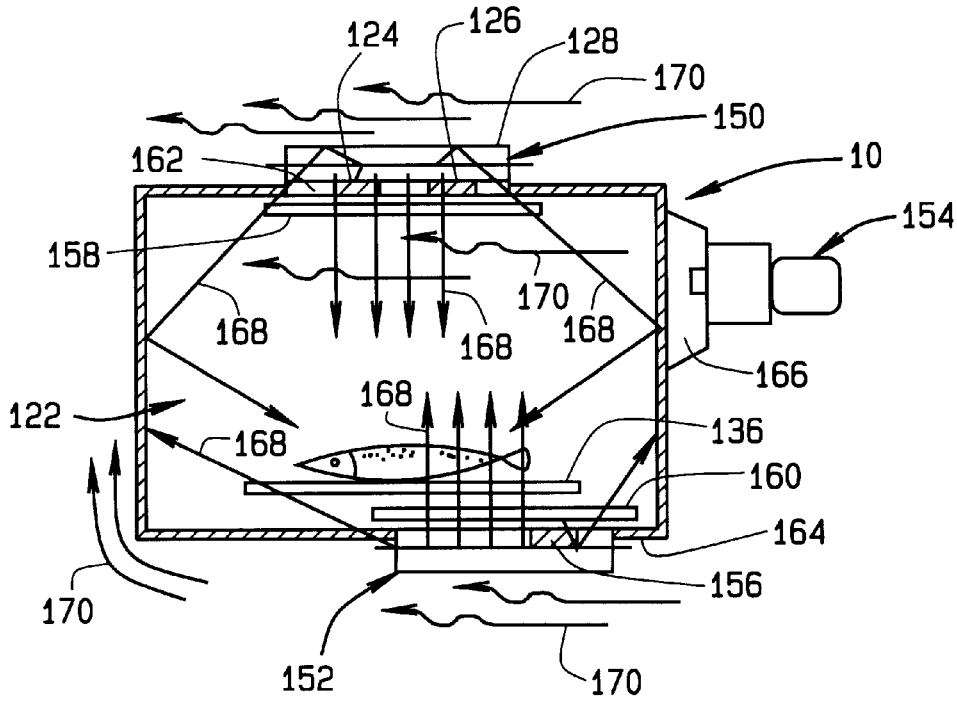
FIG. 4 is a schematic illustration of the radiant cooking unit and the microwave cooking unit relative to the cooking cavity.

FIG. 4 is a schematic illustration of oven 10, and particularly of halogen lamp cooking units 150 and 152 and microwave cooking unit 154 relative to cooking cavity 122. As shown in FIG. 3, upper cooking unit 150 includes two halogen lamps 124 and 126 and cooking unit 152 includes one halogen lamp 156. Lamps 124, 126, and 156, in an exemplary embodiment, are 1500 W halogen lamps having a color temperature of 2300K, output power of 4.5 kW with 7% in the light wave range of 0.4 um to 0.7 um, 20% to 25% in the light wave range less than 1.0 um, and 36% in the light wave range of 0.4 um to 1.35 um. Lamp 124 is referred to as the upper center lamp, and lamp 126 is referred to as the upper exterior lamp. Lamp 156 is referred to as the lower lamp. Glass plates 158 and 160 extend over cooking units 150 and 152 between lamps 124, 126, and 156 and cavity 122. Also, twist mesh screens 162 and 164 having an opening ratio of 80% are provided for additional protection. Additional details are provided below with respect to reflector 128. A magnetron 166 of microwave cooking unit 154 is located on a side of cavity 122. Magnetron 166, in an exemplary embodiment, is rated at 1000 W and delivers 950 W into cavity 122.

Figure 5:
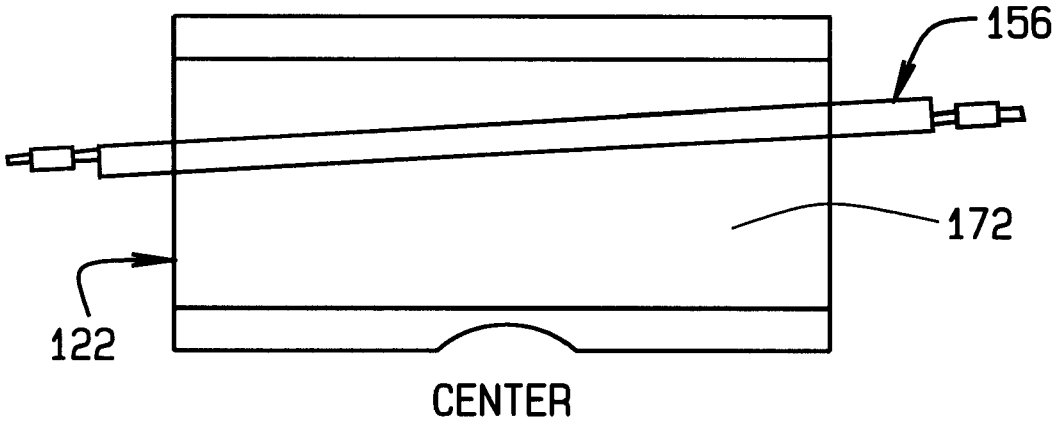
FIG. 5 is a schematic illustration of the lower lamp of the oven shown in FIG. 3.

With respect to lower lamp 156, and referring to FIG. 5, lamp 156 is located off center and at an angle relative to a bottom surface 172 of cavity 122. Such location of lower lamp 156 results, for example, in lowering the temperature of the rollers on turntable 136.

Figure 6:
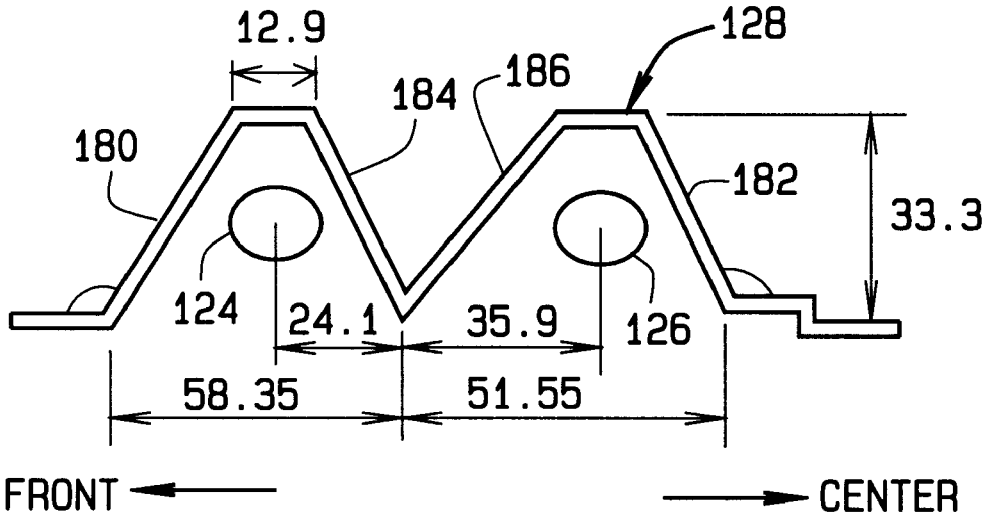
FIG. 6 is a schematic illustration of the reflector for the upper lamps of the oven shown in FIG. 3.

FIG. 6 is a schematic side illustration of reflector 128. Reflector 128 includes angular side sections 180 and 182 and angular center sections 184 and 186. The dimensions (in millimeters) indicated in FIG. 5 are exemplary and have been found suitable for at least one oven. By selecting the reflector dimensions as indicated in FIG. 5, upper lamps 124 and 126 are believed to provide more even cooking of items located on turntable 136.

Figure 7:
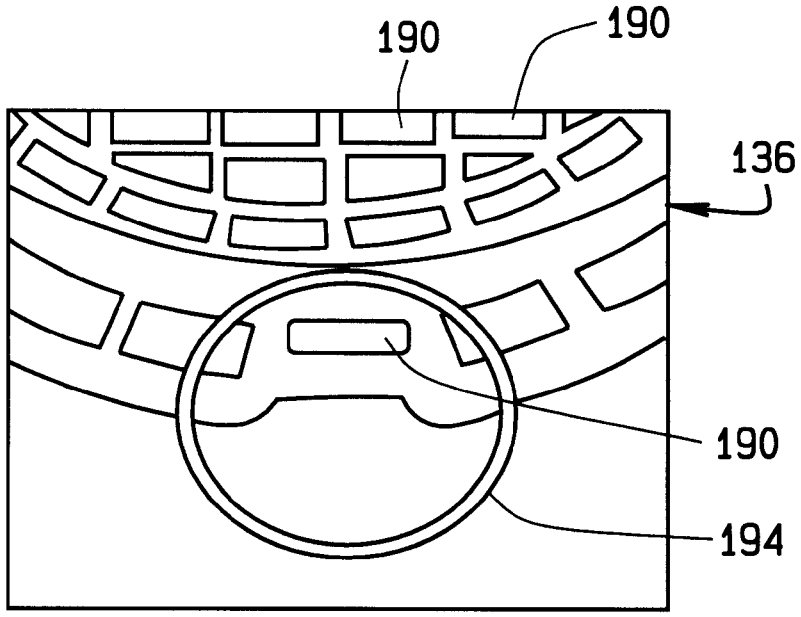
FIG. 7 is an illustration of a portion of the turntable of the oven shown in FIG. 3.

FIG. 7 illustrates a portion of turntable 136. Turntable 136 has an open grille construction with a 70% energy transmission. Turntable 136 rotates at about 6 r.p.m. and has a diameter of about 11⅛". Turntable 136 includes metal segments 190 with ceramic rollers 192, one of which is illustrated within circle 194.

Figure 8:
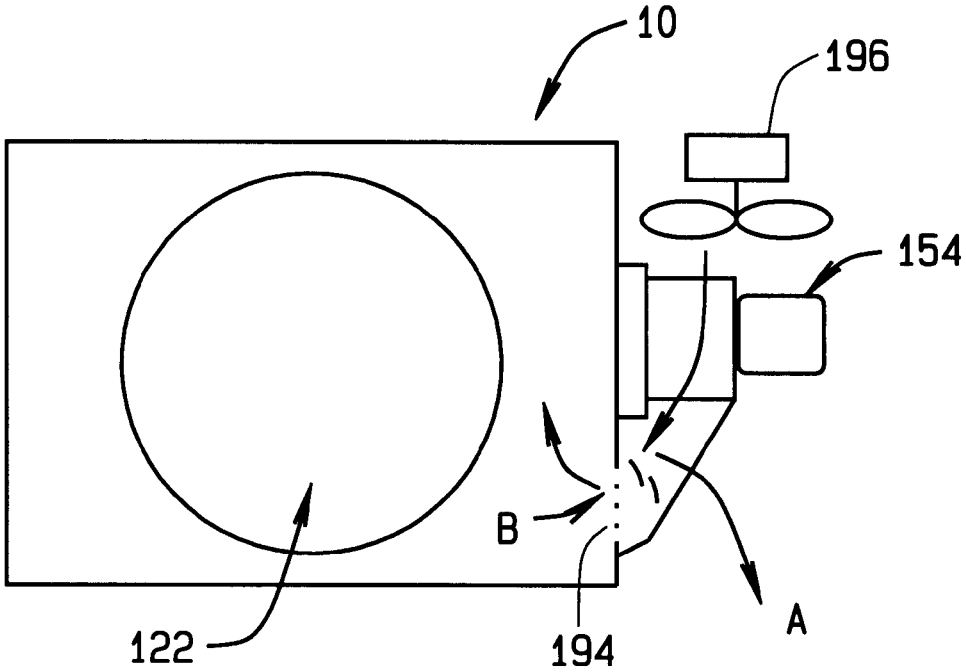
FIG. 8 is a schematic illustration of the cooking cavity of the oven shown in FIG. 3, including a damper to control air flow.

FIG. 8 illustrates a damper 194 located below microwave cooking unit 154. Damper 194 is open when in the microwave only mode to enable air to flow through cavity 122. In the speed cooking and radiant only mode, damper 194 closes to prevent air from flowing in a reverse direction and back towards microwave cooking unit 154.

Figure 9:
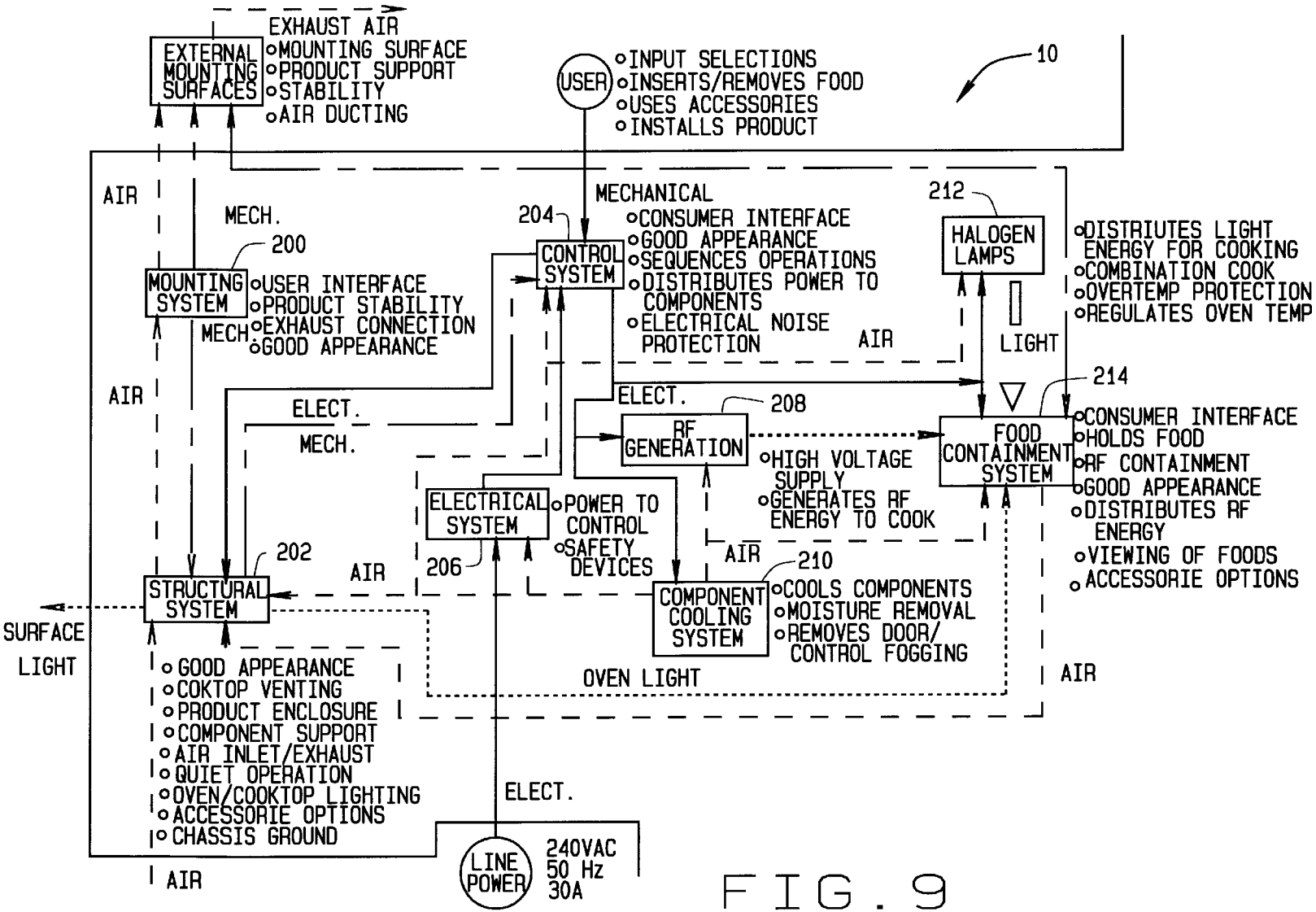
FIG. 9 is a functional block diagram of the oven shown in FIG. 1.

FIG. 9 is a functional block diagram of oven 10. As shown in FIG. 8, oven 10 includes a mounting system 200, a structural system 202, a control system 204, an electrical system 206, RF generation 208, a component cooling system 210, halogen lamps 212, and a food containment system 214. Various features of each system are indicated in FIG. 8. Mounting system 200 is provided to enable mounting oven over the range. Mounting system 200 also provides connection with an exhaust to enable removal of fumes from over the cooktop into the exhaust. Structural system 202 generally refers to shell 120, which provides an enclosure. Control system 204 includes an interface, i.e., keypads 112 and dial 48, and also distributes power to the other oven systems. Electrical system 206 powers the control and safety devices. RF generation 208 is performed by magnetron 166, and RF energy output by magnetron 166 is selectively used to cook food in food containment system. Component cooling system 210 is provided to cool the other system and to remove moisture from cavity 122. Halogen lamps 212 generate light energy used for cooking food in food containment system 214.

Figure 10:
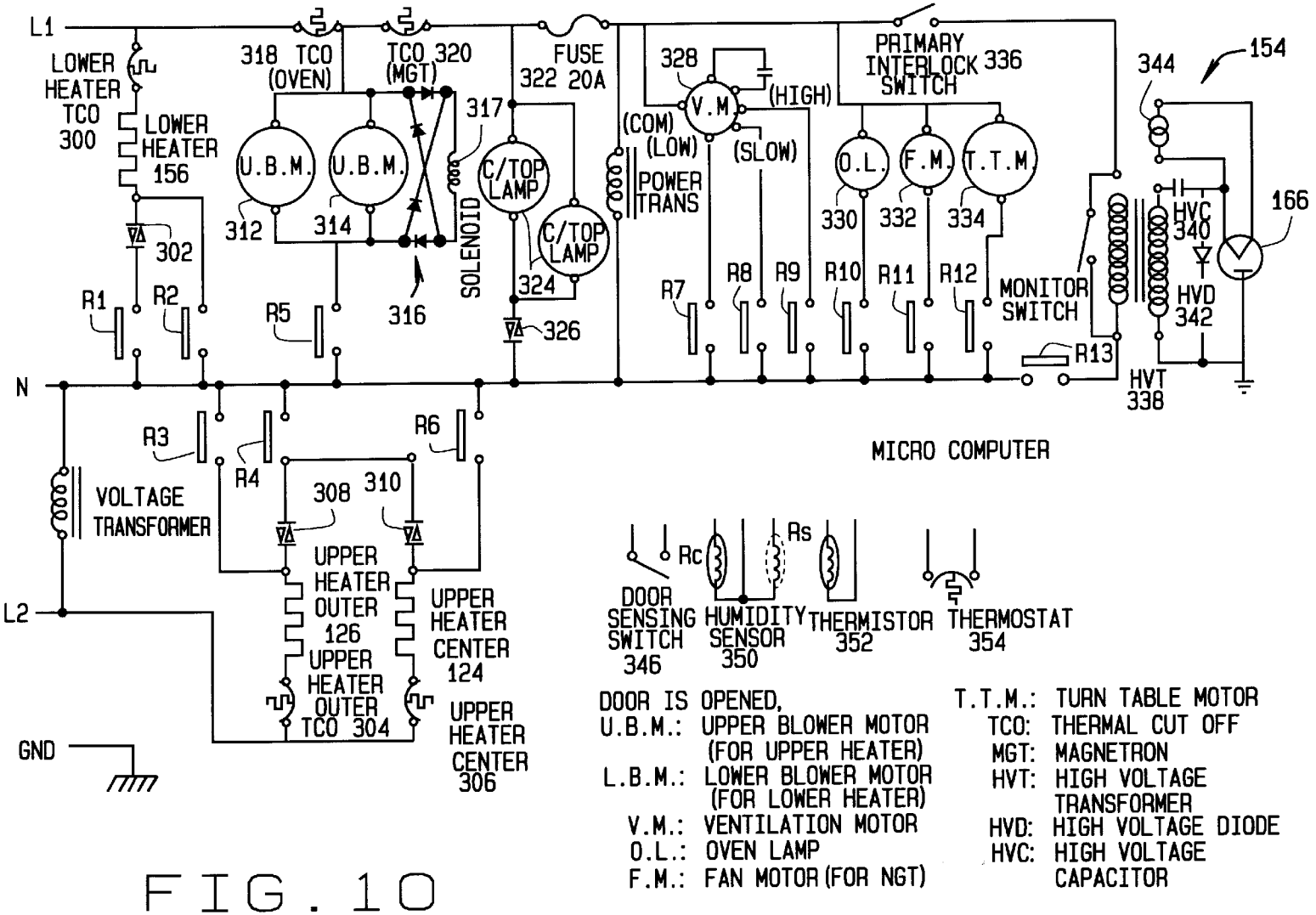
FIG. 10 is a circuit schematic diagram of the oven shown in FIG. 1.

FIG. 10 is a schematic diagram of oven 10. Power is provided to oven 10 via lines L1, L2, and N. Relays R1–R13 are connected to a microprocessor or microcomputer which is programmed to control the opening and closing thereof. Lower lamp 156 is electrically connected to line L1 via a thermal cut off 300. Energization of lower lamp 156 is controlled by relays R1 and R2. A triac is in series with relay R1 to provide a soft start, as described below in more detail. Upper lamps 126 and 124 are connected to line L2 via thermal cut offs 304 and 306. Triacs 308 and 310 are in series with relay R4.

Relays R1 and R4 are air gap type relays, and are in series with triacs 302 and 308, respectively. Relays R1 and R4 are closed in the soft start operation of respective lamps 124, 126, and 156 to enable energization of triacs 302 and 308. After completion of the soft start, relays R1 and R4 are open. Relays R2, R3, and R6 are controlled by the micro computer to close after the soft start is completed to maintain energization of lamps 124, 126, and 156 based on the particular power setting.

Oven 10 also includes an upper blower motor 312 and a lower blower motor 314 for cooling. A rectifier circuit 316 is provided for rectifying an AC input signal to a DC output signal to be supplied to a solenoid 317. Solenoid 317, when energized, closes damper 194. Thermal cut outs 318 and 320 and a fuse 322 also are provided to protect oven components, e.g., from overheating or an overcurrent condition. Cooktop lamps 324 are electrically connected in series with a triac 326 and are provided for illuminating the cooktop. Rectifier circuit 316 and solenoid 317 may be replaced with a small synchronous motor.

A vent motor 328 having low, slow, and high speeds selectable via relays R7, R8, and R9 is provided for removing fumes from over the cooktop. An oven lamp 330, a fan motor 332, and a turn table motor 334 are controlled by separate relays R10, R11, and R12. A primary interlock switch 336 is located in door 102 and prevents energization of cooking elements unless door 102 is closed. A relay R13 controls energization of microwave cooking unit 154. Microwave cooking unit 154 includes a high voltage transformer 338 which steps up the supply voltage from 120V to 2000V. A high voltage capacitor 340 and a high voltage diode 342 circuit steps up the voltage from transformer 338 from 2000V to 4000V. This high voltage is supplied to magnetron 166 and the output of magnetron 166 is supplied to a waveguide 344 which directs RF energy into cooking cavity 122. As also shown in FIG. 9, oven 10 includes a door sensing switch 346 for sensing whether door 102 is opened, a humidity sensor 348 for sensing the humidity in cooking cavity 122, a thermistor 350, and a base thermostat 352.

With respect to speed cooking operation of oven 10, the microcomputer controls relays R1–R6 and R13 based on the power level either associated with the preprogrammed cooking program or manually entered. In the speed cooking mode, for example, if a power level 9 is selected, the upper exterior lamp 124 has a target on-time of 29 seconds of a 32 second duty cycle, upper center lamp 126 has a target on-time of 25 seconds of a 32 second duty cycle, lower lamp 156 has a target on-time of 29 seconds of a 32 second duty cycle, and magnetron 16 has a target on-time of 29 seconds of a 32 second duty cycle. A duty cycle of 32 seconds is selected for one particular implementation. However, other duty cycles could be utilized. Set forth below is a chart which sets forth the target on-times based on power level.

| Power Level | Upper Exterior Lamp | Upper Center Lamp | Lower Lamp | Magnetron |
|---|---|---|---|---|
| 0 | 0 | 0 | 0 | 0 |
| 1 | 3 | 3 | 3 | 3 |
| 2 | 6 | 5 | 6 | 6 |
| 3 | 10 | 8 | 10 | 10 |
| 4 | 13 | 11 | 13 | 13 |
| 5 | 16 | 14 | 16 | 16 |
| 6 | 19 | 16 | 19 | 19 |
| 7 | 22 | 19 | 22 | 22 |
| 8 | 26 | 22 | 26 | 26 |
| 9 | 29 | 25 | 29 | 29 |
| 10 | 32 | 27 | 32 | 32 |

To increase lamp reliability, a soft start operation is used when energizing lamps 124, 126, and 156. Particularly, in accordance with the soft start operation, triacs 302, 308, and 310 are utilized to delay lamp turn-on. For example, upper exterior lamp 126 and lower lamp 156 are delayed for one second from commanded turn-on to actual turn-on. Upper center lamp 124 is delayed for two seconds from commanded turn-on to actual turn-on. Therefore, the target turn-on times are different from the commanded on-times. Set forth below is a table containing the commanded on-times based on power level selected.

| Power Level | Upper Exterior Lamp | Upper Center Lamp | Lower Lamp | Magnetron |
|---|---|---|---|---|
| 0 | 0 | 0 | 0 | 0 |
| 1 | 4 | 5 | 4 | 3 |
| 2 | 7 | 7 | 7 | 6 |
| 3 | 11 | 10 | 11 | 10 |
| 4 | 14 | 13 | 14 | 13 |
| 5 | 17 | 16 | 17 | 16 |
| 6 | 20 | 18 | 20 | 19 |
| 7 | 23 | 21 | 23 | 22 |
| 8 | 27 | 24 | 27 | 26 |
| 9 | 30 | 27 | 30 | 29 |
| 10 | 32 | 29 | 32 | 32 |

For example, if upper lamps 124 and 126 are to operate at power level 7, then upper lamp 124 would be commanded to operate for 21 seconds and upper exterior lamp 126 would be commanded to operate for 23 seconds. Lamps 124 and 126 would be commanded to turn-on for 21 and 23 seconds, respectively, at the beginning of each 32 second duty cycle. Due to the soft-start delays, lamps 124 and 126 would actually be on for 19 seconds (lamp 124) and 22 seconds (lamp 126) of each 32 second duty cycle.

Figure 11:
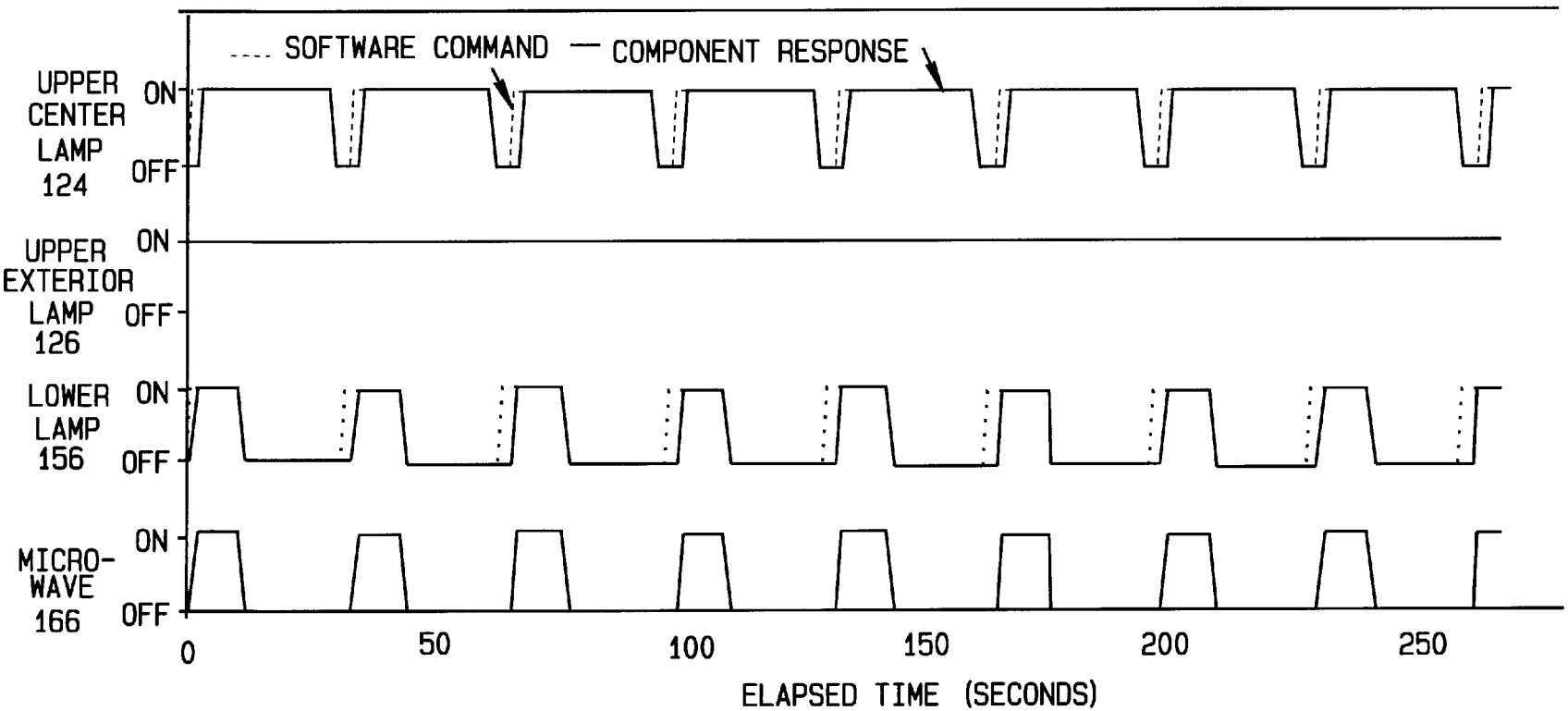
FIG. 11 is a timing diagram illustrating target and command times for energizing the cooking elements.

FIG. 11 is a timing diagram illustrating the state of lamps 124, 126, and 156, and magnetron 166. In the example, refrigerated crescent rolls are to be cooked in accordance with the following:

| | |
|---|---|
| Total Time: | 4:30 |
| Upper Power Level: | 10 |
| Lower Power Level: | 3 |
| Microwave Power Level: | 3 |

As shown in FIG. 11, upper center lamp 124 is commanded on (dashed line) two seconds before it actually turns on (solid line). Lamp 124 is on for 27 seconds of each 32 second period. Upper exterior lamp 126 is always on during this period. Lower Lamp 156 is on one second after it is commanded to turn on, and is on for 10 seconds out of each 32 second period. Magnetron 166 has no delay between command and execution of on time, and is on for 10 seconds of each 32 second period.

Figure 13:
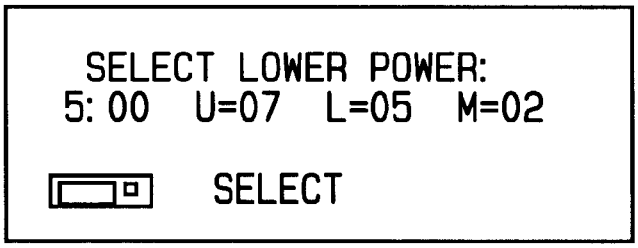
Figure 14:
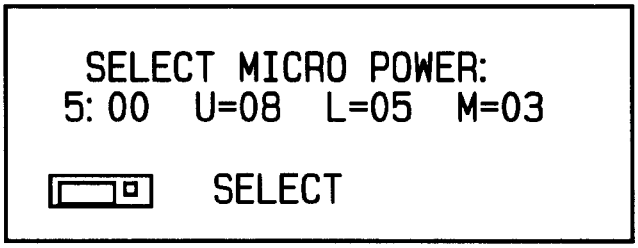
Figure 15:
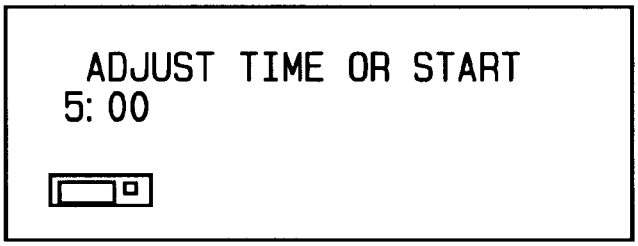

An operator may enter control information, including a selected total cooking time and power levels for desired cooking units, as well as adjusting the cooking time and power level of the upper lamps, the lower lamp, and the microwave during operation. For manual entry of parameters to a control algorithm, MANUAL COOK control pad 64 is depressed and "Select COOK TIME" is displayed on alphanumeric display 50. By rotating rotary dial 48 to increment or decrement the displayed cooking time, a COOK TIME may be selected and rotary dial 48 depressed to enter the selected COOK TIME. Once COOK TIME is entered, a message "Select UPPER POWER" is displayed as shown in FIG. 11. Rotation of dial 48 then enables an operator to select the upper power level (clockwise rotation increases the power level and counter clockwise rotation decreases the power level). When dial 48 is pressed to enter the selection, a short beep sounds and "Select LOWER POWER" is displayed as shown in FIG. 13. Dial rotation then alters the current lower power level, and when dial 48 is pressed to enter the selection, a short beep is sounded. Then, "Select MICRO POWER" is displayed as shown in FIG. 14. Dial rotation now alters the microwave power level. When dial 48 is pressed to enter the selection, a short beep is sounded and the OVEN icon flashes and the SELECT icon is turned off. "ADJUST TIME or START" is then displayed as shown in FIG. 15. The time may be adjusted or the START pad pressed.

Figure 12:
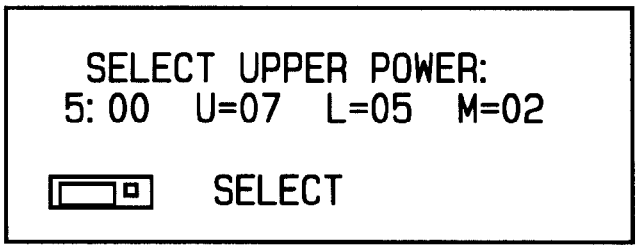
FIGS. 12–15 illustrate messages displayed when adjusting/entering the power level and cooking time.

A user may depress control panel POWER LEVEL pad 68 to adjust power levels of desired cooking units during operation of oven 10. When the power level pad is pressed at an acceptable time during lightwave cooking, i.e., one or more of the lamps are energized, the cooking countdown continues and the UPL (FIG. 11), LPL (FIG. 12) and MPL (FIG. 13) displays appear. The same operation as described above is utilized except that after entering the new microwave power level, 2 short beeps are sounded and the countdown and UPL, LPL and MPL display continue for 2.0 seconds. After 2.0 seconds, the UPL, LPL and MPL displays are removed and only the cooking countdown continues. If the power level pad is pressed when it is not allowed to change/enter or recall the power level, a beep signal (0.5 seconds at 1000 hz) sounds and the message "POWER LEVEL MAY NOT BE CHANGED AT THIS TIME" scrolls on alphanumeric display 50. After the scroll has completed, the previous foreground features return. If the power level pad is pressed at a time when a change/entry is allowed, but no dial rotation or entry occurs within 15 seconds, the UPL, LPL and MPL display are removed and alphanumeric display 50 returns to the cooking countdown.

Figure 16:
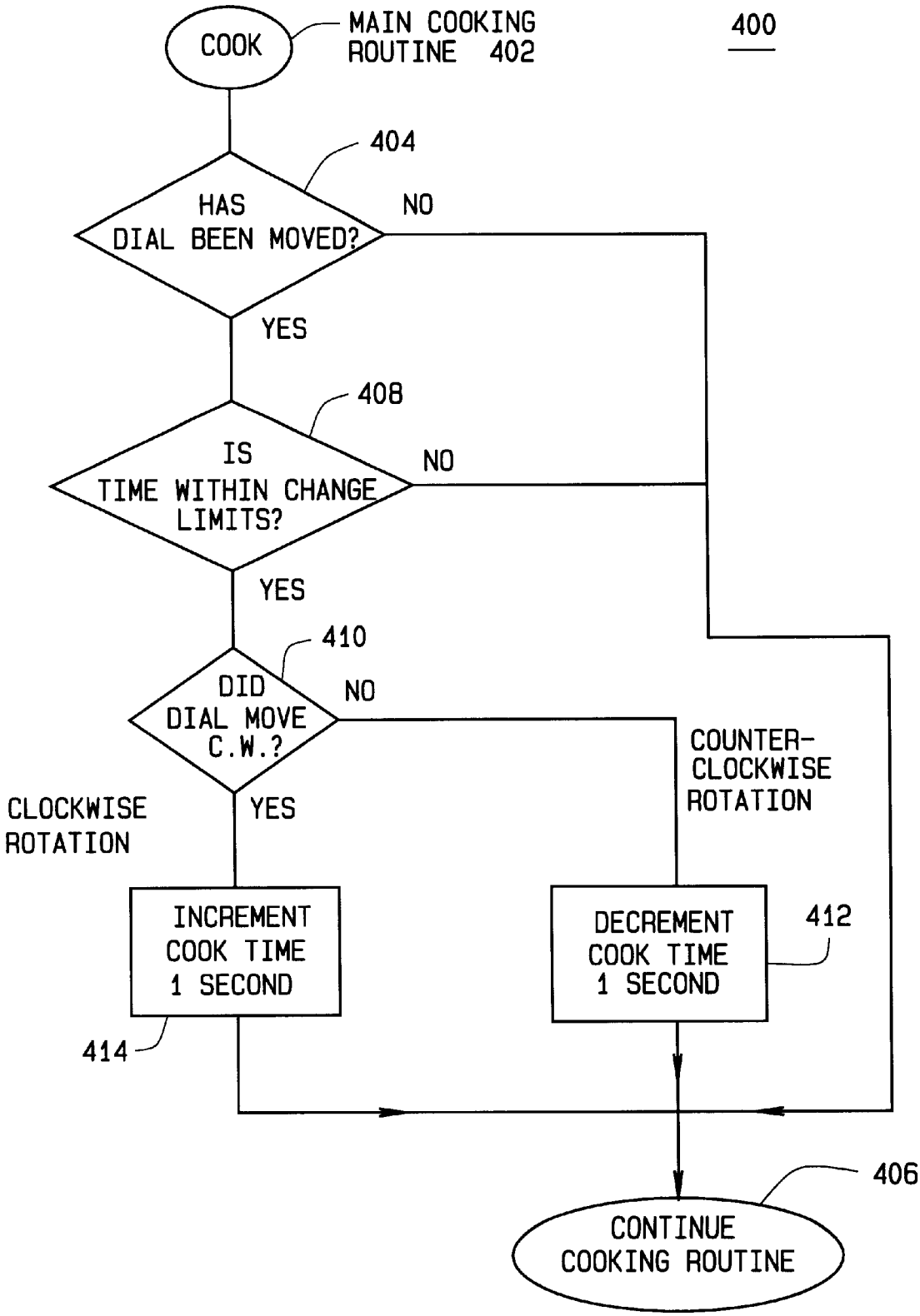
FIG. 16 is a flow chart illustrating process steps executed when adjusting the cook time.

FIG. 16 is a flow chart 400 illustrating process steps executed when adjusting the cook time during cooking operations. During cooking operations, a main cooking routine COOK is executed. If dial 48 is not moved 404, the main cooking routine continues to be executed 406. If dial 48 is moved 404, then the microcomputer determines whether a time change can be made, e.g., is the time remaining within the change limits 408. For example, if only 15 seconds remain in a cooking operation, no time change may be allowed to prevent an operator from shutting down a cooking operation by rotating dial 48 until zero is displayed, sometimes referred to as a "hard shutdown", which may not be desirable. If the remaining time is not within the change limits, then the main cooking routine continues to be executed 406. If the remaining time is within the change limits, then the micro computer determines whether dial 48 was moved clockwise 410. If no (i.e., dial 48 was moved counterclockwise), then for each increment that dial 48 is moved, the cook time is decremented by one second 412. If yes, then for each increment that dial 48 is moved, the cook time is incremented by one second 414.

Figure 17:
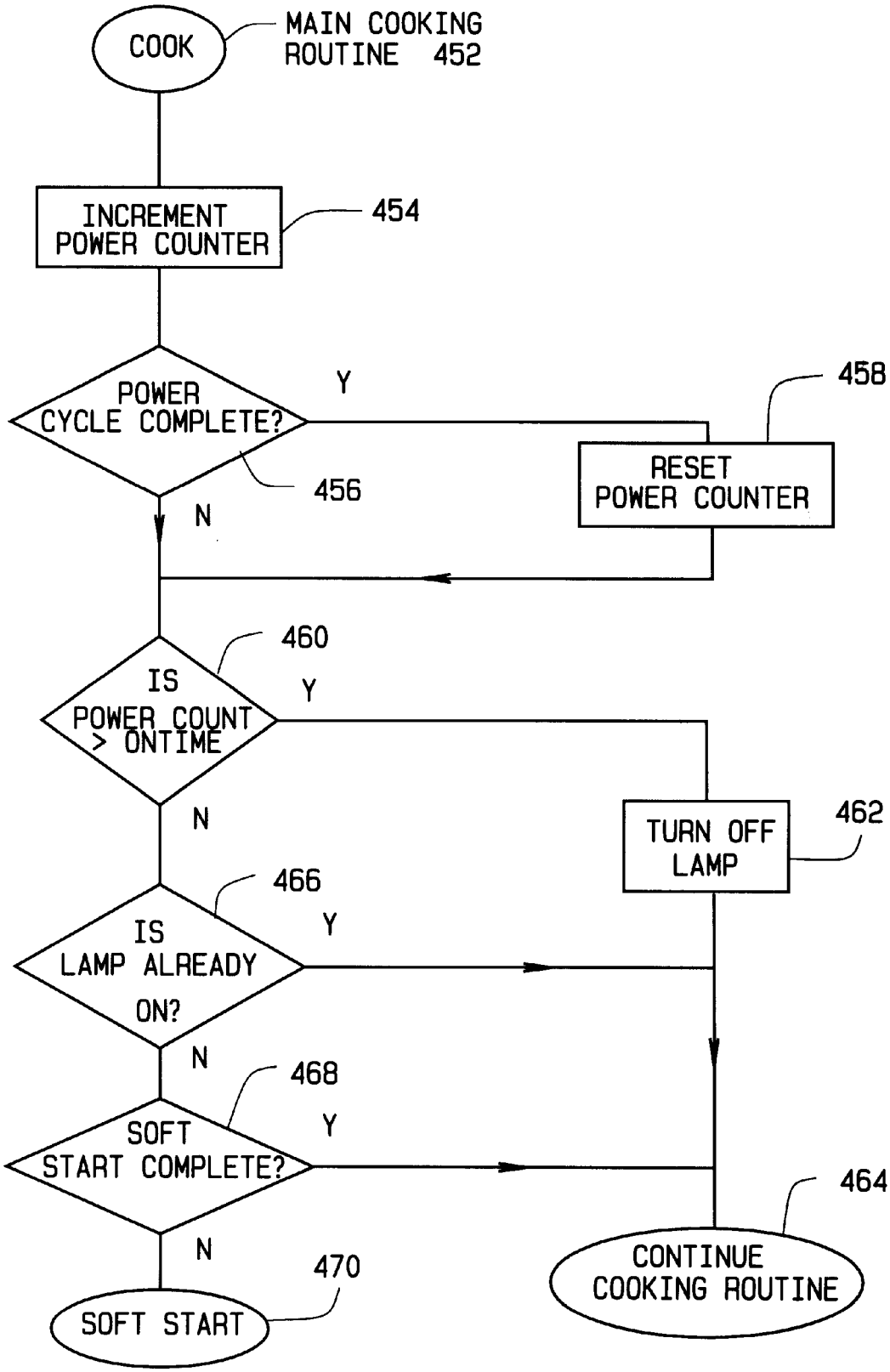
FIG. 17 is a flow chart illustrating process steps for lamp power level control.

FIG. 17 is a flow chart illustrating process steps 450 for lamp power level control. Such control is used to control energization of lamps 124, 126, and 156 (FIG. 9). More particularly, a main cooking routine 452 is executed during normal cooking operations. A power counter is incremented 454 for each one second interval, and the microcomputer then checks whether a power cycle is complete 456. For example, and as explained above, each duty cycle has a duration of 32 seconds. If the duty cycle is complete, then the power counter is reset 458. If the duty cycle is riot complete, or after resetting the counter, then the micro computer checks whether the power count is greater than the "on time" 460. The "on time" is equal to the time corresponding to the selected power level for each lamp, as explained above. If the power count is greater than the "on time", then the particular lamp is de-energized 462 and cooking continues with the main cooking routine 464. If the power count is less than or equal to the "on time", then the micro computer checks whether the lamp is already on 466. If yes, then cooking operations continue 464. If no, then the micro computer checks whether the soft start has been completed 468. If the soft start has been completed, then operations continue with the cooking routine 464. If soft start operations are not complete, then the soft start routine is called 470.

Figure 18:
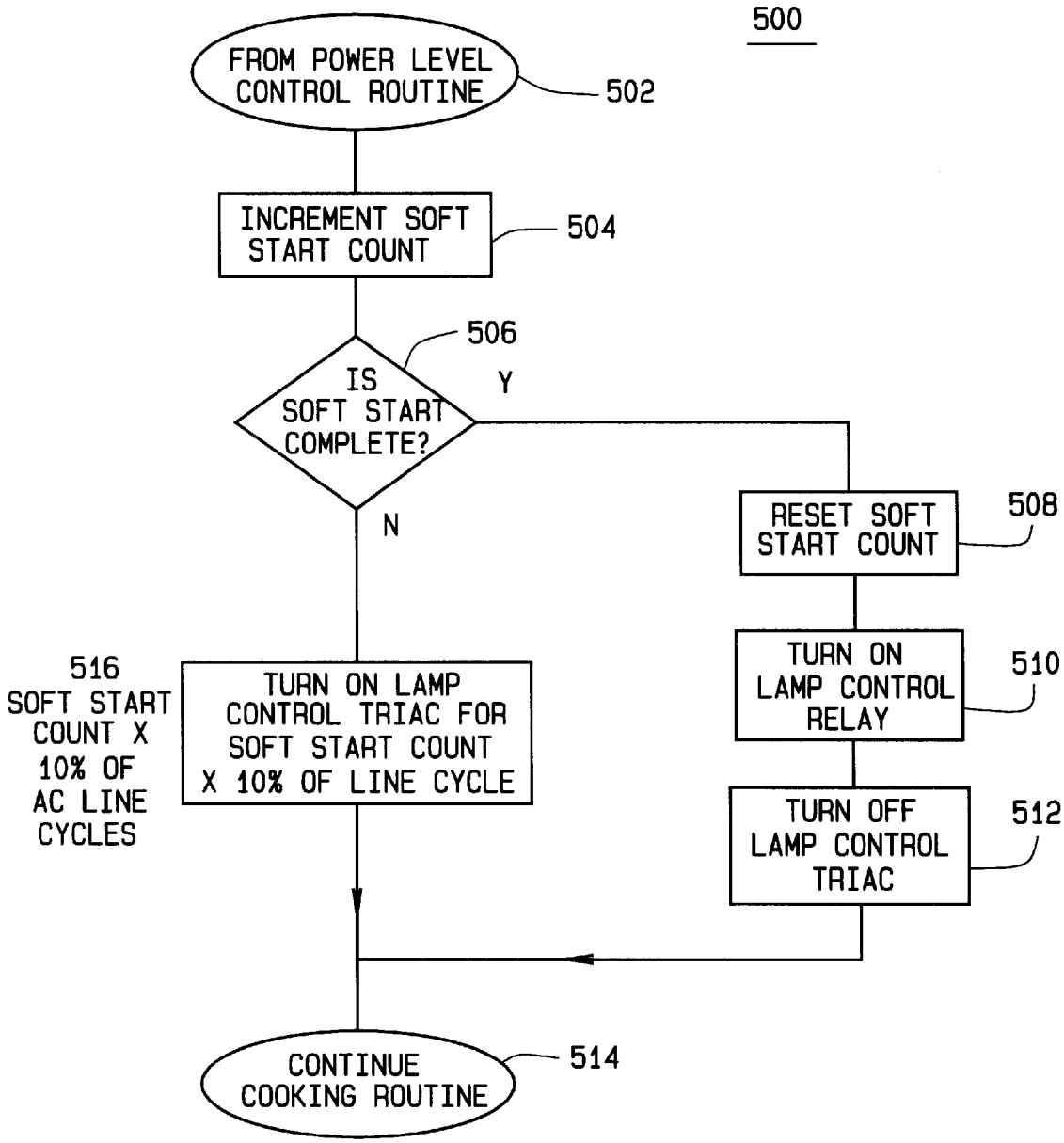
FIG. 18 is a flow chart illustrating process steps for the soft start of the Halogen lamps.

FIG. 18 is a flow chart illustrating process steps for the soft start routine 500. As explained above, the soft start for the halogen lamps is utilized to increase the lamp reliability. When routine 500 is called from the power level control routine 502, the microcomputer increments a soft start counter 504. The micro computer then determines whether the soft start is complete (e.g., depending on the lamp, the soft start has a duration of 1 or 2 seconds, as explained above). If soft start is complete, the microcomputer resets the soft start counter 508, turns on the lamp control relay 510, and turns off the lamp control triac 512. Operations then proceed to the cooking routine 514. If soft start is not complete, the micro computer turns on the, lamp control triac for a soft start count×10% of the line cycle 516. Operations then proceed to the cooking routine.

The glass of oven door 26 (shown in FIG. 2) is very dark and does not enable visualization of food within cavity 122 (shown in FIG. 2) unless at least one of the Halogen lamps is on and sufficiently energized to illuminate cavity 122. Therefore, in some cooking operations such as the microwave only mode of cooking or when radiant cooking at low power levels, and in order to visualize food in cooking cavity 122, an operator may select the microwave button on control panel 40. When this pad is selected during cooking, the microcomputer energizes upper center lamp 124 for four seconds at full power (i.e., power level 10), with a soft start, i.e., two seconds of soft start and two seconds of power level 10 energization for a total of four seconds, as described above. Lamp 124 illuminates the cooking cavity sufficiently so that an operator can visualize the food through window 30.

While the invention has been described in terms of various specific embodiments, those skilled in the art will recognize that the invention can be practiced with modification within the spirit and scope of the claims.

What is claimed is:

1. A speed cooking oven comprising:

a cooking cavity;

a microwave cooking unit for delivering microwave energy into said cooking cavity and operable at a number of POWER LEVEL settings;

at least one radiant cooking unit for delivering radiant energy into said cooking cavity and operable at said number of POWER LEVEL settings;

a control panel operatively connected to said microwave cooking unit and to said at least one radiant cooking unit for user manipulation to select desired oven features, said control panel comprising at least a MANUAL COOK button; and a microprocessor operatively connected to said control panel and configured to execute a manually entered control algorithm in response to user manipulation of said MANUAL cook button, said manually entered control algorithm defined by a user selected total COOK TIME and a user selected one of said number of POWER LEVEL settings for said microwave cooking unit and one of said number of POWER LEVEL settings for said at least one radiant cooking unit.

2. A speed cooking oven in accordance with claim 1 wherein said control panel further comprises a rotary dial input configured to select said total COOK TIME and said POWER LEVELS.

3. A speed cooking oven in accordance with claim 1 said number of power levels is ten, and wherein said control panel further comprises an alphanumeric display configured to display selected COOK TIME and selected POWER LEVELS.

4. A speed cooking oven in accordance with claim 1 wherein said at least one radiant cooking unit comprises an upper cooking unit comprising an upper radiant lamp, and a lower cooking unit comprising a lower radiant lamp.

5. A speed cooking oven in accordance with claim 4 wherein said control algorithm is based upon a selected total COOK TIME, a selected UPPER POWER LEVEL for said upper cooking unit, a selected LOWER POWER LEVEL for said lower cooking unit, and a selected MICRO POWER level for said microwave cooking unit.

6. A speed cooking oven in accordance with claim 5 wherein said microprocessor is programmed to prompt a user for entry of said TOTAL COOK TIME, UPPER POWER LEVEL, LOWER POWER LEVEL, and MICRO POWER LEVEL when said MANUAL COOK button is depressed.

7. A speed cooking oven in accordance with claim 6 wherein said control panel further comprises an alphanumeric display, said microprocessor further programmed to display said prompts on said alphanumeric display.

8. A speed cooking oven in accordance with claim 6 wherein said control panel comprises a rotary dial input selector for selection of said COOK TIME and said POWER LEVELS by rotary movement of said dial.

9. A method for operating a speed cooking oven including a plurality of radiant cooking lamps and a microwave cooking unit for delivering cooking energy into a cooking cavity, a control panel for user manipulation to select one of a predetermined number of power level settings of the cooking lamps and microwave cooking unit, the control panel including an alphanumeric display and a MANUAL COOK button, and a microprocessor coupled to the radiant cooking lamps and microwave cooking unit and to the control panel for executing a prescribed manually entered control algorithm, said method comprising the steps of:

when the MANUAL COOK button is depressed, prompting a user to enter a total COOK TIME;

prompting a user to independently enter a POWER LEVEL setting for each of the radiant cooking lamps; and prompting a user to independently enter a MICRO POWER level setting for the microwave cooking unit.

10. A method in accordance with claim 9 further comprising the step of prompting a START command to execute the selected cooking algorithm.

11. A method in accordance with claim 9 wherein each said step of prompting comprises displaying a message on the alphanumeric display.

12. A method in accordance with claim 9 wherein the oven includes an upper cooking unit, a lower cooking unit, and a microwave cooking unit, said step of displaying a message comprising the steps of:

displaying "Select UPPER POWER" on the alphanumeric display when prompting a user for entry of a power level for the upper cooking unit;

displaying "Select LOWER POWER" on the alphanumeric display when prompting a user for entry of a power level for the lower cooking unit; and displaying "Select MICRO POWER" on the alphanumeric display when prompting the user for entry of a power level for the microwave cooking unit.

13. A method in accordance with claim 9 further comprising the step of displaying an icon on the alphanumeric display when prompting user entry of a control algorithm.

14. A method in accordance with claim 9 wherein said microprocessor is programmed to further execute the step of executing an audible confirmation of a prompted user entry.

15. A speed cooking oven comprising:

a cooking cavity;

an upper cooking unit for delivering radiant energy into said cooking cavity;

a lower cooking unit for delivering radiant energy into said cooking cavity;

a microwave cooking unit for delivering microwave energy into said cooking cavity;

a control panel for user manipulation of desired cooking operations, said control panel comprising at least a MANUAL COOK button;

an alphanumeric display coupled to said control panel for indicating available cooking options from manipulation of said control panel; and a microprocessor coupled to said control panel, said alphanumeric display and to said upper cooking unit, lower cooking unit, and said microwave cooking unit, said microprocessor programmed to execute a manually entered cooking control algorithm in response to user manipulation of said MANUAL COOK button, said manually entered cooking control algorithm utilizing four user defined and independently selected cooking constants including a COOK TIME for cooking operation, an UPPER POWER LEVEL corresponding to relative energization of said upper cooking unit during said COOK TIME, a LOWER POWER LEVEL corresponding to relative energization of said lower cooking unit during said COOK TIME, and a MICRO POWER LEVEL corresponding to relative energization of said microwave cooking unit during said COOK TIME.

16. A speed cooking oven in accordance with claim 15 wherein the microprocessor is programmed to prompt user input of COOK TIME, UPPER POWER LEVEL, LOWER POWER LEVEL, and MICRO POWER LEVEL upon user manipulation of the control panel.

17. A speed cooking oven in accordance with claim 16, said microprocessor programmed to prompt user entry of COOK TIME, UPPER POWER LEVEL, LOWER POWER LEVEL, and MICRO POWER LEVEL upon user manipulation of the MANUAL COOK button.

18. A speed cooking oven in accordance with claim 16 wherein the control panel comprises a rotary dial, said microprocessor programmed to prompt user entry of COOK TIME, UPPER POWER LEVEL, LOWER POWER LEVEL, and MICRO POWER LEVEL upon user manipulation of the rotary dial.

19. A speed cooking oven comprising:

a cooking cavity;

a microwave cooking unit for delivering microwave energy into said cooking cavity;

at least one upper radiant cooking unit and a lower radiant cooking unit for delivering radiant energy into said cooking cavity;

a control panel operatively connected to said microwave cooking unit and to said at least one radiant cooking unit; said control panel configured to select preprogrammed cooking algorithms and manually entered cooking algorithms input by a user upon manipulation of a MANUAL COOK button; and a microprocessor operatively connected to said control panel configured, after said MANUAL COOK BUTTON is depressed, to execute a manually entered control algorithm based upon user defined inputs including a total COOK TIME, an UPPER POWER LEVEL comprising one of a number of predetermined power level settings corresponding to a target on time of said upper radiant cooking unit, a LOWER POWER LEVEL comprising one of said number of predetermined power level settings corresponding to a target on time of said lower radiant cooking unit, and a MICRO POWER LEVEL comprising one of said number of predetermined power level settings corresponding to a target on time of said microwave cooking unit.

20. A speed cooking oven in accordance with claim 19 wherein said number of predetermined power level settings is ten.

* * * * *

UNITED STATES PATENT AND TRADEMARK OFFICE

CERTIFICATE OF CORRECTION

PATENT NO. : 6,525,301 B1 
DATED : February 25, 2003
INVENTOR(S) : Graves et al.

It is certified that error appears in the above-identified patent and that said Letters Patent is hereby corrected as shown below:

Column 1,
Line 40, delete “correctly” and insert therefor -- incorrectly --.
Line 44, delete “a radiant ovens” and insert therefor -- a radiant oven --.

Column 10,
Line 1, delete “riot” and insert therefor -- not --.
Line 28, delete “the micro computer turns on the, lamp control triac for a soft start countx10% of the line cycle 516.” and insert therefor -- the micro computer turns on the lamp control triac for a soft start count x 10% of the line cycle 516. --.

Signed and Sealed this

Eighteenth Day of November, 2003

JAMES E. ROGAN
*Director of the United States Patent and Trademark Office*